United States Patent [19]

Mather

[11] 4,131,639

[45] Dec. 26, 1978

[54] SULFURIC ACID EXTRACTION OF URANIUM FROM ITS ORES

[75] Inventor: James T. Mather, Elliot Lake, Canada

[73] Assignee: Rio Algom Limited, Ontario, Canada

[21] Appl. No.: 736,775

[22] Filed: Oct. 28, 1976

[30] Foreign Application Priority Data

Nov. 4, 1975 [GB] United Kingdom ..... 45801/75

[51] Int. Cl.[2] ..... C01G 43/00

[52] U.S. Cl. ..... 423/20; 423/18

[58] Field of Search ..... 423/18, 20

[56] References Cited

U.S. PATENT DOCUMENTS

| | | | |
|---|---|---|---|
| 2,875,023 | 2/1959 | Galvanek | 423/18 |
| 2,945,741 | 7/1960 | Stedman | 423/18 |
| 3,025,131 | 3/1962 | Lerner | 423/20 |
| 3,777,004 | 12/1973 | Lankenau et al. | 423/20 |
| 3,808,306 | 4/1974 | Smith et al. | 423/18 |

*Primary Examiner*—Edward A. Miller

*Attorney, Agent, or Firm*—Holman & Stern

[57] ABSTRACT

A method of extracting uranium from its ores, by mixing ground ore with sulphuric acid to give a moist ore containing a sulphuric acid concentration of less than 4N, without forming a continuous liquid phase, and curing the moist ore at 50° to 100° C while passing an oxidizing gas through it.

8 Claims, No Drawings

SULFURIC ACID EXTRACTION OF URANIUM FROM ITS ORES

BACKGROUND OF THE INVENTION

This invention relates to the extraction of uranium from its ores, and in particular to an improved method for acid leaching of uranium from its ores and especially from those ores which contain uranium as a finely-disseminated refractory material, such as brannerite or uraninite, as found for example in the Elliot Lake area of Canada.

Most current uranium ore processing employs leaching in dilute sulphuric acid (less than 1N), although an alkaline leaching process has been developed for ores containing a high content of acid-consuming constituents such as carbonates. The established acid leaching process for Elliot Lake ores is somewhat more severe than the above, requiring fine grinding (40 to 60 percent-200 mesh), a long reaction time (2–3 days) in an aerated pulp of relatively high density (60–70% solids), a temperature of 60° to 80° C., and an acid addition of 60–80 lb $H_2SO_4$ per short ton of ore.

Approximately half of the added acid is rapidly consumed in reactions with acid-consuming constituents of the ore, while the remainder of the acid provides a free acid concentration of about 0.7N $H_2SO_4$ in order to achieve a practical leaching rate. At the completion of the leach the excess free acid must be neutralized before further processing for uranium recovery. As this leaching process requires long residence times at fairly high free acid concentrations, tanks in which it is carried out have to be large and rubber-lined and thus represent a major capital cost item. Mechanical agitation of the leaching tanks has proved to be unsatisfactory and therefore air agitated pachuca tanks are used. Large quantities of compressed air are consumed in these tanks, and associated evaporative heat losses are very high, leading to significantly higher operating costs than for mills handling less refractory materials.

Canadian Patent Specification No. 938,453, issued Dec. 18, 1973, describes and claims a strong acid pug leaching process for such ores, using sulphuric acid of a concentration greater than 4N at a typical addition of 60 lbs $H_2SO_4$ per short ton of ore, and a curing temperature of 65°–100° C. This process is operated on relatively coarsely-ground ore of a top size not substantially smaller than 1 mm. However, the use of strong acid at elevated temperatures has certain disadvantages, particularly:

- extraction of unwanted impurities tends to be higher than with dilute acid;
- in order to adequately wet the ore with more concentrated acid, more contained $H_2SO_4$ must be added than is otherwise required for satisfactory leaching;
- attack on most commonly used corrosion-resistant materials is more severe than with dilute acid, especially above 75° C., where unusual materials must be resorted to;
- dry grinding must be employed if a relatively high acid concentrations is required, which is poor practice from an environmental viewpoint for uranium ores.

The limit of conventional fine crushing is presently ⅜ inch (9.51 mm), and hence to comminute the ore to a top size of about 1–1.5 mm for the above mentioned strong acid process, dry grinding must be employed. Dust control in dry grinding circuits is difficult, and in the case of the Elliot Lake conglomerate ores in particular, the dust hazard is extreme due to the radioactivity and high free silica content of these materials.

I have now found that an increase in the acid concentration does not necessarily equate with higher uranium extraction and faster leaching rates, and that maintenance of a suitable oxidizing environment is more important than acid concentration for obtaining high uranium extraction from refractory ores, maximum extraction being of prime importance for a product of such high value as uranium.

SUMMARY OF THE INVENTION

The present invention provides a method of extracting uranium values from an ore which contains uranium as a finely-disseminated refractory material, comprising grinding the ore, mixing it with sulphuric acid to give a moist ore containing a sulphuric acid concentration of less than 4N, without forming a continuous liquid phase, and curing the moist ore at from 50° to 100° C. while passing an oxidizing gas through it.

The sulphuric acid concentration, before leaching begins, i.e. in the initial moist pug, is preferably from 2N to 3N, more preferably about 2.5N.

The curing time is preferably from 12 to 24 hours.

The oxidizing gas may be suitably air which is preferably moistened.

A total volume of at least 20 cubic feet of air is preferably passed per short ton of moist ore during the curing period.

The fineness of the ground ore is not critical. However, it is preferred that the majority of the particles shall generally be less than 1 mm in size, more preferably less than 0.6 mm.

Normally the ore will have been ground wet, then thickened and filtered to remove excess water, and will therefore contain from 10 to 15% of water. In practice, the moisture content of the damp ore will be controlled so that the ore is adequately wet for diffusion of reagents, yet possesses suitable bulk properties for satisfactory aeration. To this moist ore will be added sufficient concentrated sulphuric acid (commercial grade 93.2%) to give a moist ore containing the required acid concentration (usually from 2N to 3N), without forming a continuous liquid phase.

Using the method according to the invention it is possible to achieve uranium extractions of 95% or better in a relatively short period of time (24 hours or less) using a pug leaching process employing acid of an initial concentration substantially less than 4N if the damp pug is contacted with an oxidizing gas during the curing period. In addition, there may be achieved a major reduction in the acid requirement to around 35 lb $H_2SO_4$ per short ton of ore from a typical value of 60 lb $H_2SO_4$ per ton for other previously known methods of leaching. There are corresponding major reductions in reagents needed for neutralizing the process effluents. It has also been found that the air consumption for this process is a small fraction (about 5%) of that required for agitation in the conventional previously known method. Overall, substantial savings in the costs of reagents and services can thus be effected.

A further advantage of the low acid cure with aeration is that it prevents concretion of the cured ore into hard lumps.

DETAILED DESCRIPTION OF THE PREFERRED EMBODIMENT

The invention will be further described with reference to the following illustrative example carried out on finely-ground Quirke ore from the Elliot Lake area of Canada. A typical ore analysis is as follows:

| | | | |
|---|---|---|---|
| $U_3O_8$ | 3.43 lb/ton | sec. $U_3O_8$ | 0.99 lb/ton |
| Th | 0.66 % | | |
| Fe | 2.97 | | |
| Al | 3.58 | | |
| Na | 0.05 | | |
| K | 1.39 | | |
| Mg | 0.06 | | |
| Ca | 0.04 | | |
| S | 3.15 | | |
| $CO_2$ | 0.09 | | |

EXAMPLE (According to the Invention)

A 655 pound sample of this finely ground ore (42% -200 mesh) was adjusted to a moisture content of 10.5% moisture and with 3000 ml of 95.5% $H_2SO_4$ (35.4 lbs $H_2SO_4$ per short ton of ore) in a blender for 15 seconds, and then transferred to a six inch diameter, 40 foot high, water-jacketed leaching column. The pug was cured for 24 hours at 70° C. while passing 500 mls/minute of air through the column. The average extraction was 96.6% and the air consumption was about 72 $ft^3$/ton ore.

COMPARATIVE EXAMPLE (Not According to the Invention)

A 626 pound sample of the same ore was adjusted to a moisture content of 10.0%, 4300 ml of 95.5% $H_2SO_4$ was added (53 lbs of $H_2SO_4$ per short ton of ore), and the pug was blended and transferred to the same column. Curing was continued for 24 hours at 75°–80° C. but without aeration. At the end of this time the ore had cemented into hard agglomerates, and was difficult to remove from the column. Extraction averaged 92.4% and oxidation was variable.

I claim:

1. A method of extracting uranium values from an ore which contains uranium as a finely-disseminated refractory material, comprising the steps of: wet grinding the ore; dewatering the ground ore; mixing the ground ore with concentrated sulphuric acid; adjusting the sulphuric acid contentration in the moist ore to an initial concentration of less than 4N; curing the moist ore by heating the moist ore to a temperature of from 50° to 100° C. while passing an oxidizing gas through the moist ore; and recovering acid-soluble uranium values from the cured ore by dissolution.

2. The method according to claim 1 in which the initial sulphuric acid concentration in the moist ore is from 2N to 3N.

3. The method according to claim 1 in which the curing time is from 12 to 24 hours.

4. The method according to claim 1 in which the oxidizing gas is air.

5. The method according to claim 4 in which the air is moistened.

6. The method according to claim 4 in which a total volume of at least 20 cubic feet of air is passed per short ton of moist ore during the curing period.

7. The method according to claim 1 in which the particle size of the ground ore is predominantly less than 1 mm.

8. The method according to claim 1 in which the ore is dewatered to contain from 10 to 15% water and the initial sulphuric acid concentration in the moist ore is from 2N to 3N.

* * * * *